US008671843B2

(12) United States Patent
Johnston et al.

(10) Patent No.: US 8,671,843 B2
(45) Date of Patent: Mar. 18, 2014

(54) AUTOMATIC CARRIAGE RETURN FOR EXHAUST REMOVAL SYSTEM

(76) Inventors: John Johnston, El Dorado Hills, CA (US); Brian Roe, Auburn, CA (US)

( * ) Notice: Subject to any disclaimer, the term of this patent is extended or adjusted under 35 U.S.C. 154(b) by 0 days.

(21) Appl. No.: 13/541,310

(22) Filed: Jul. 3, 2012

(65) Prior Publication Data

US 2013/0160668 A1 Jun. 27, 2013

Related U.S. Application Data

(63) Continuation-in-part of application No. 12/925,995, filed on Nov. 4, 2010, now Pat. No. 8,393,277.

(60) Provisional application No. 61/280,435, filed on Nov. 4, 2009.

(51) Int. Cl.
*B61B 9/00* (2006.01)

(52) U.S. Cl.
USPC ..... 104/178; 104/173.1

(58) Field of Classification Search
USPC ..... 105/30, 32, 33; 104/89, 91, 93, 108, 104/173.1, 117.1, 238, 178, 229, 230, 231, 104/232, 233, 234, 202, 112, 173.2, 162, 104/172.4, 176, 179, 180, 181, 239, 193; 454/63, 64

See application file for complete search history.

(56) References Cited

FOREIGN PATENT DOCUMENTS

WO WO 97/30801 * 8/1997

* cited by examiner

*Primary Examiner* — Mark Le

(74) *Attorney, Agent, or Firm* — John Pelham Johnston; Brian Anthony Roe

(57) ABSTRACT

An automatic carriage return for an exhaust removal system having a carriage that is configured to translate along a track tube. The automatic carriage return includes a drive cable spanning along the track tube, and an engagement assembly coupled to the carriage. A drive motor drives motion of the carriage along the drive cable when the engagement assembly is in the engaged configuration. In the disengaged configuration, the engagement assembly is configured to be disengaged from the drive cable to allow the carriage to freely follow the path of the vehicle. Upon release of the extraction hose from the vehicle, the engagement assembly is configured to automatically activate to the engaged configuration to engage the drive cable.

20 Claims, 10 Drawing Sheets

AUTOMATIC CARRIAGE RETURN FOR EXHAUST REMOVAL SYSTEM

CROSS-REFERENCE TO RELATED APPLICATIONS

This application is a continuation in part of U.S. application Ser. No. 12/925,995, filed on Nov. 4, 2010 now U.S. Pat. No. 8,393,277, which claims priority from U.S. provisional application Ser. No. 61/280,435, filed on Nov. 4, 2009, herein incorporated by reference in its entirety.

BACKGROUND OF THE INVENTION

1. Field of the Invention

The present invention relates generally to systems and methods for a vehicle exhaust extraction system. More particularly, the invention is directed to systems and methods for a vehicle exhaust extraction system with automatic return.

2. Description of the Related Art

Emergency vehicles, such as fire engines, typically have an exhaust removal/extraction system that is coupled to the exhaust of the vehicle while the vehicle is started in the bay of the station, and travels with the vehicle until the vehicle exits the vehicle bay, at which point the exhaust removal tube detaches from the vehicle. The exhaust removal carriage, which is generally carried along a track above the vehicle, remains at the exit of the bay until it is manually moved back to the bay entrance, where it awaits return of the vehicle.

Accordingly, an object of the present invention is to provide an automated system that automatically returns the exhaust extraction assembly to the rear of the bay upon release of the vehicle. Another object of the present invention is to provide a retrofit system that automatically returns the exhaust extraction assembly to the rear of the bay upon release of the vehicle. At least some of these objectives will be met in the following description.

BRIEF SUMMARY OF THE INVENTION

An aspect of the present invention is an automatic carriage return for an exhaust removal system. In one embodiment, the return is configured to be retrofit to an existing exhaust extraction system having a carriage that is configured to translate along a track tube, the carriage being coupled at a first end to an exhaust extraction hose, the second end of the exhaust extraction hose being coupled to a vehicle exhaust for directing exhaust from the vehicle out the track tube. The automatic carriage return includes a drive cable spanning along a path adjacent to and substantially parallel with the track tube, and an engagement assembly coupled to the carriage. The engagement assembly has an engaged configuration and a non-engaged configuration with respect to the drive cable. A drive motor is coupled to the engagement assembly, the drive motor being configured to drive motion of the carriage along the drive cable when the engagement assembly is in the engaged configuration. In the disengaged configuration, the engagement assembly is configured to be disengaged from the drive cable while the exhaust extraction hose is attached to the exhaust of a vehicle to allow the carriage to freely follow the path of the vehicle. Wherein, upon release of the extraction hose from the vehicle, the engagement assembly is configured to automatically activate to the engaged configuration to engage the drive cable.

In one embodiment, at least one of the engagement assembly and drive motor are pneumatically driven. For example, the drive motor may comprise a pneumatic drive motor, and the engagement assembly comprises a pneumatic drive cylinder that is configured to drive the engagement assembly to and from the disengaged configuration to the engaged configuration.

In another embodiment, the engagement assembly comprises a lever arm housing one or more upper wheels, wherein the lever arm is configured to house the one or more upper wheels at an orientation that does not significantly deflect the drive cable in the disengaged configuration. In the engaged configuration, the lever arm is configured to engage the one or more upper wheels with the drive cable such that the drive cable deflects on to a drive wheel coupled to the drive motor.

In a further embodiment, a first sensor is coupled to the carriage and is configured to sense a first location of the carriage with respect to the track tube and send a signal to operate the pneumatic drive cylinder to engage the engagement assembly and the pneumatic drive motor to drive translation of the carriage along the drive cable.

In another embodiment, the return includes a motor controller valve, wherein the first sensor comprises a first trigger valve, and the motor controller valve is configured to sense a pneumatic signal from the first trigger valve. The motor controller valve is configured to control the delivery of air to the pneumatic drive motor and pneumatic drive cylinder to operate the pneumatic drive motor and pneumatic drive cylinder to operate upon receiving said pneumatic signal.

In one mode of the current embodiment, a second sensor comprising a second trigger valve is included that is configured to sense a second location of the carriage with respect to the track tube. The second trigger valve is configured to send a signal to the motor controller valve to operate the pneumatic drive cylinder to disengage the engagement assembly and the turn off pneumatic drive motor to stop translation of the carriage along the drive cable.

Another aspect is an exhaust removal system with automatic carriage return, comprising a carriage being coupled at a first end to an exhaust extraction hose, wherein the carriage is configured to translate along a track tube. A second end of the exhaust extraction hose is configured to be coupled to a vehicle exhaust for directing exhaust from the vehicle out the track tube. A drive cable spans along a path adjacent to and substantially parallel with the track tube. An engagement assembly is coupled to the carriage, the engagement assembly having an engaged configuration and a non-engaged configuration with respect to the drive cable. A drive motor coupled to the engagement assembly, the drive motor being configured to drive motion of the carriage along the drive cable when the engagement assembly is in the engaged configuration. In the disengaged configuration, the engagement assembly is configured to be disengaged from the drive cable while the exhaust extraction hose is attached to the exhaust of a vehicle to allow the carriage to freely follow the path of the vehicle. Upon release of the extraction hose from the vehicle, the engagement assembly is configured to automatically activate to the engaged configuration to engage the drive cable.

In one embodiment of the current aspect, the drive motor comprises a pneumatic drive motor, and the engagement assembly comprises a pneumatic drive cylinder that is configured to drive the engagement assembly to and from the disengaged configuration to the engaged configuration.

In a further embodiment, a first sensor is coupled to the carriage and is configured to sense a first location of the carriage with respect to the track tube. The first sensor is configured to send a signal to release the second end of the exhaust extraction hose from the vehicle exhaust. The first sensor is further configured to send a second signal to operate the pneumatic drive cylinder to engage the engagement assembly and the pneumatic drive motor to drive translation of the carriage along the drive cable.

Another aspect is a method for automatically returning a carriage for an exhaust removal system. The method includes the steps of coupling a first end of the carriage to an exhaust extraction hose, coupling a second end of the exhaust extraction hose to a vehicle exhaust for allowing the carriage to translate along a track tube as the vehicle moves in a first direction while directing exhaust from the vehicle out the track tube, releasing a second end of the exhaust extraction hose from the vehicle exhaust, engaging a drive cable with an engagement assembly coupled to the carriage, wherein the drive cable spans along a path adjacent to and substantially parallel with the track tube. The engagement assembly has an engaged configuration and a non-engaged configuration with respect to the drive cable. The method further includes driving motion of the carriage in a second direction opposite to the first direction along the drive cable when the engagement assembly is in the engaged configuration. In the disengaged configuration, the engagement assembly is configured to be disengaged from the drive cable while the exhaust extraction hose is attached to the exhaust of a vehicle to allow the carriage to freely follow the path of the vehicle. Upon release of the extraction hose from the vehicle, the engagement assembly is configured to automatically activate to the engaged configuration to engage the drive cable.

In one embodiment of the current aspect, engaging a drive cable and driving motion of the carriage are done pneumatically.

In another embodiment, the method includes sensing a first location of the carriage with respect to the track tube, sending a pneumatic signal to release the second end of the exhaust extraction hose from the a vehicle exhaust, and sending a second signal to operate a pneumatic drive cylinder to engage the engagement assembly and the pneumatic drive motor to drive translation of the carriage along the drive cable.

In another embodiment, the method includes sensing a second location of the carriage with respect to the track tube, and sending a third signal to operate the pneumatic drive cylinder to disengage the engagement assembly and the turn off pneumatic drive motor to stop translation of the carriage along the drive cable.

Another aspect is an automatic carriage return for an exhaust removal system having a carriage that is configured to translate in first and second directions along a track tube, the carriage being coupled to an exhaust extraction hose, the exhaust extraction hose being coupled to a vehicle exhaust for directing exhaust from the vehicle out the track tube, the automatic carriage return comprising a drive line spanning along a path adjacent to and substantially parallel with the track tube and an engagement catch coupled to the carriage, wherein the engagement catch is configured to engage the drive cable while the carriage is travelling in the first direction. The drive line and engagement catch are configured such that the carriage moves independently of the drive line when the carriage is traveling in the second direction. A drive (e.g. drive motor or the like) is coupled to the drive line, wherein the drive is configured to drive motion of the drive line and carriage in the first direction.

In one embodiment, the carriage is configured to travel in the second direction from a first location along the track to a second location along the track while the exhaust extraction hose is coupled to a vehicle exhaust.

In another embodiment, the drive and drive line are configured return the carriage from the second location to the first location.

A further embodiment includes a first sensor in electrical communication with the drive that is configured to sense a first trigger location of the carriage with respect to the track tube. The first trigger location corresponds to the carriage being at or near the second location of the track tube. The drive motor is configured to drive motion of the drive line and carriage in the first direction upon the first sensor sensing the carriage at the first trigger location.

Another embodiment includes a second sensor in electrical communication with the drive that is configured to sense a second trigger location of the carriage with respect to the track tube corresponding to the carriage being at or near the first location on the track tube. The drive motor is configured to drive motion of the drive line in the second direction upon the second sensor sensing the carriage at the second trigger location.

Another embodiment includes a third sensor in electrical communication with the drive configured to sense a location of the drive line respect to the track tube. The drive motor is configured stop motion of the drive line in the second direction upon the third sensor sensing the location of the drive line.

In a further embodiment, a controller is coupled to the first sensor, second sensor, third sensor, and the drive, and is configured to initiate engagement of the drive upon receiving data from one or more of the first sensor, second sensor, third sensor.

In a preferred embodiment, the drive line comprises a drive belt supported around one or more pulleys, and the drive comprises a drive motor that drives the one or more pulleys.

Another aspect is an exhaust removal system with automatic carriage return, comprising a carriage and an exhaust extraction hose, wherein the carriage being coupled to a first end of the exhaust extraction hose. The carriage is configured to translate in first and second directions along a track tube. A second end of the exhaust extraction hose is configured to be releasably coupled to a vehicle exhaust for directing exhaust from the vehicle out the track tube. A drive line spans along a path adjacent to and substantially parallel with the track tube. The system includes an engagement catch coupled to the carriage, the engagement catch configured to engage the drive cable while the carriage is travelling in the first direction. The drive line and engagement catch are configured such that the carriage moves independently of the drive line when the carriage is traveling in the second direction. A drive is coupled to the drive line, the drive configured to drive motion of the drive line and carriage in the first direction.

Another aspect is a method for automatically returning a carriage for an exhaust removal system, comprising: coupling a first end of the carriage to an exhaust extraction hose; coupling a second end of the exhaust extraction hose to a vehicle exhaust for allowing the carriage to translate along a track tube as the vehicle moves in a first direction while directing exhaust from the vehicle out the track tube, wherein the track tube comprising an exit end and entrance end; releasing a second end of the exhaust extraction hose from the vehicle exhaust; engaging a drive line with the carriage that spans along a path adjacent to and substantially parallel with the track tube; allowing the carriage to translate in the first direction independently of the drive line from the entrance end of the track tube; and upon the carriage reaching the exit end of the track tube, driving motion of the carriage via the drive line in a second direction to return the carriage to the entrance end of the track tube.

In one embodiment, the method further includes sensing a first location of the carriage with respect to the track tube corresponding to the carriage being at or near the exit end of the track tube, and driving motion of the drive line in response to sensing the first location of the carriage to engage and drive the carriage in the first direction to return the carriage to the entrance end of the track tube.

In one embodiment, the method further includes sensing a second location of the carriage with respect to the track tube corresponding to the carriage being at or near the entrance end of the track tube, and driving motion of the drive line in response to sensing the second location of the carriage to translate the drive line in the second direction.

In one embodiment the method further includes sensing a location of the drive line with respect to the track tube corresponding to an engagement element of location of the drive line being at or near the exit end of the track tube, and stopping motion of the drive line in response to sensing the location of the drive line.

Further aspects of the invention will be brought out in the following portions of the specification, wherein the detailed description is for the purpose of fully disclosing preferred embodiments of the invention without placing limitations thereon.

DETAILED DESCRIPTION OF THE INVENTION

The present invention, detailed in FIGS. 1 to 9 below, is directed to devices and methods for automatic return of the carriage and extraction hose portion of an exhaust removal system to the entrance side of a drive-through vehicle bay after it has been pulled to the exit side by a departing vehicle.

Figure 1:
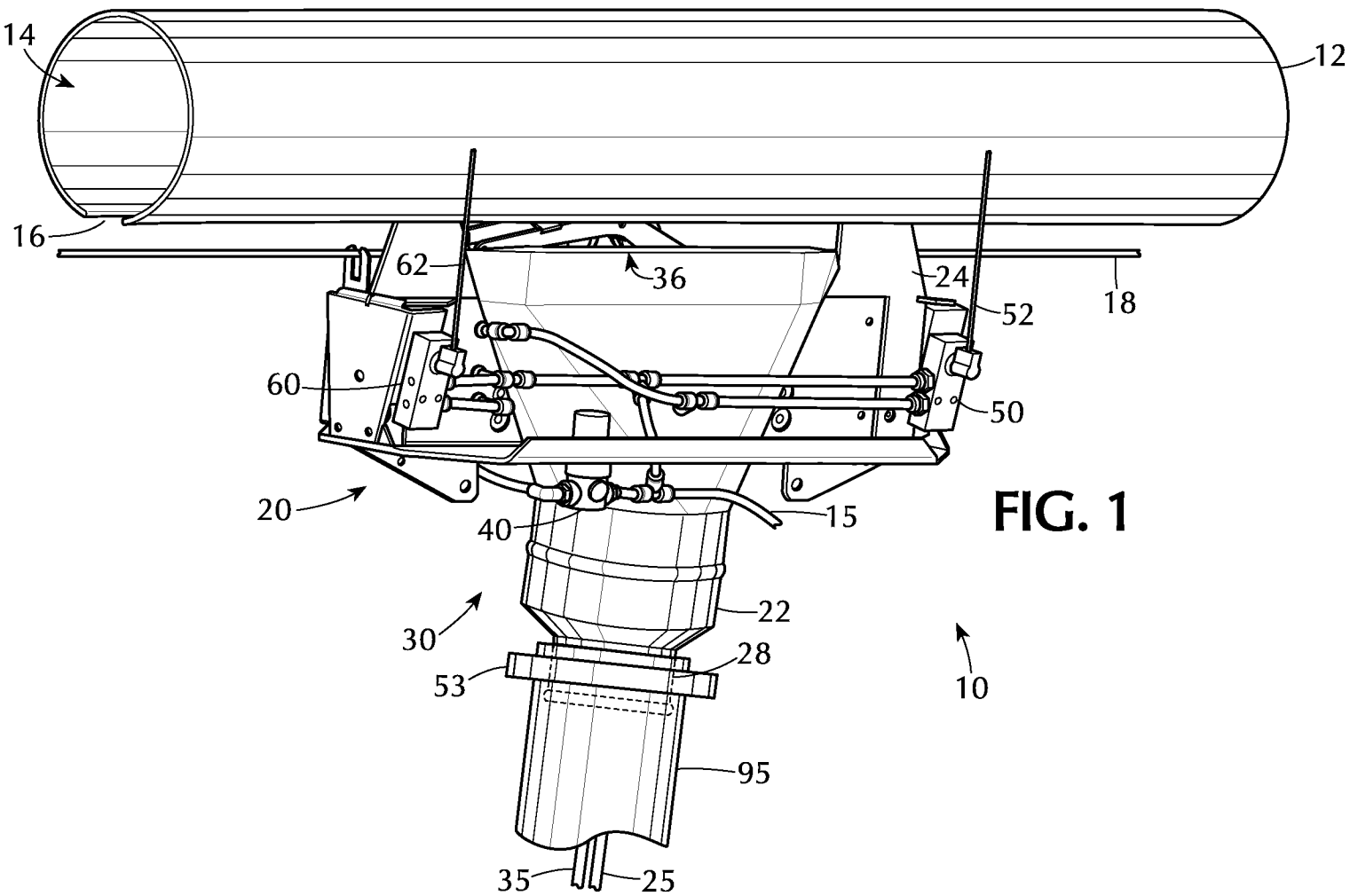
FIG. 1 is a perspective view of the control side of the automatic carriage return of the present invention.
Figure 2:
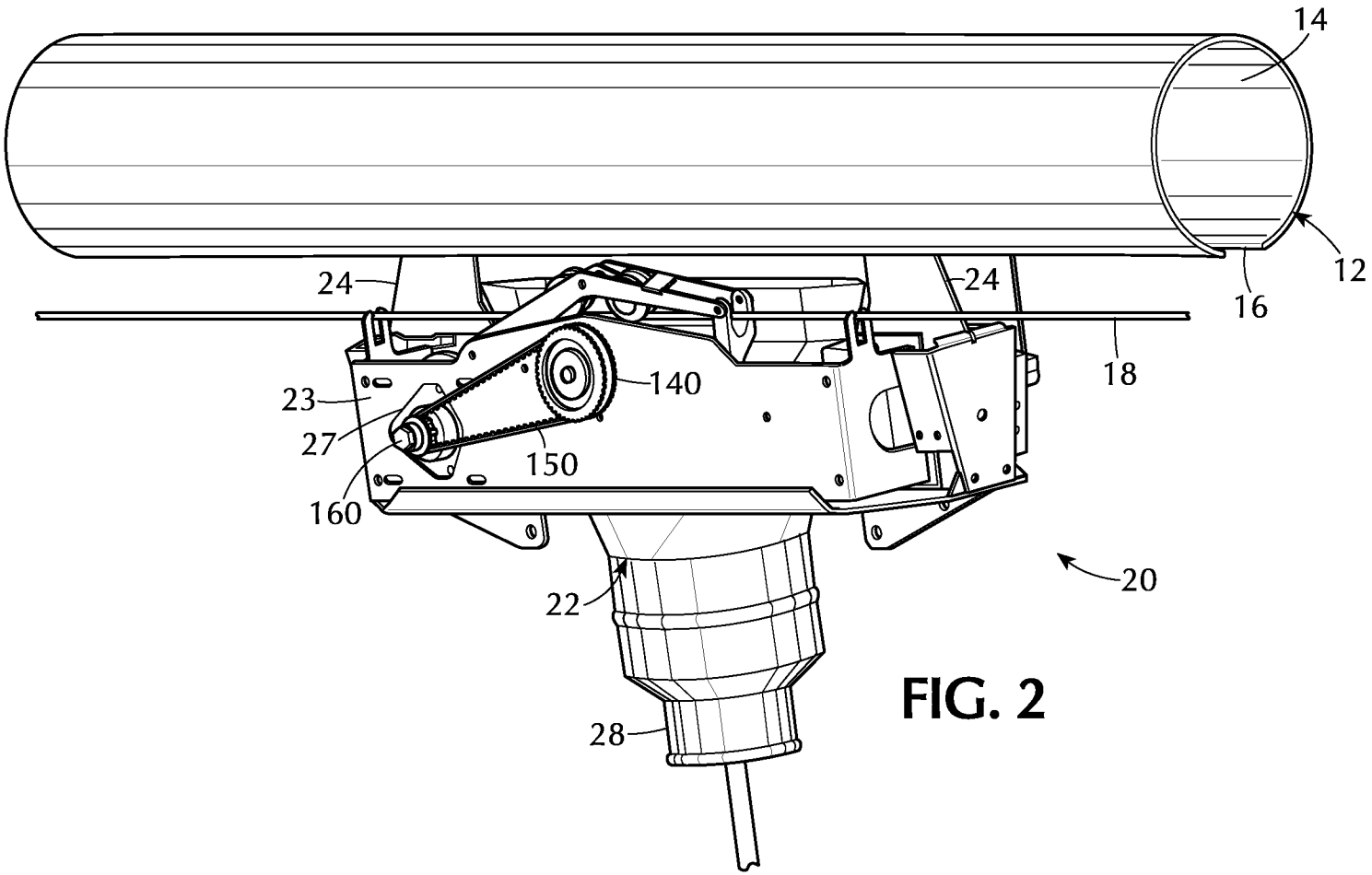
FIG. 2 is a perspective view of the drive side of the automatic carriage return of FIG. 1.
Figure 3:
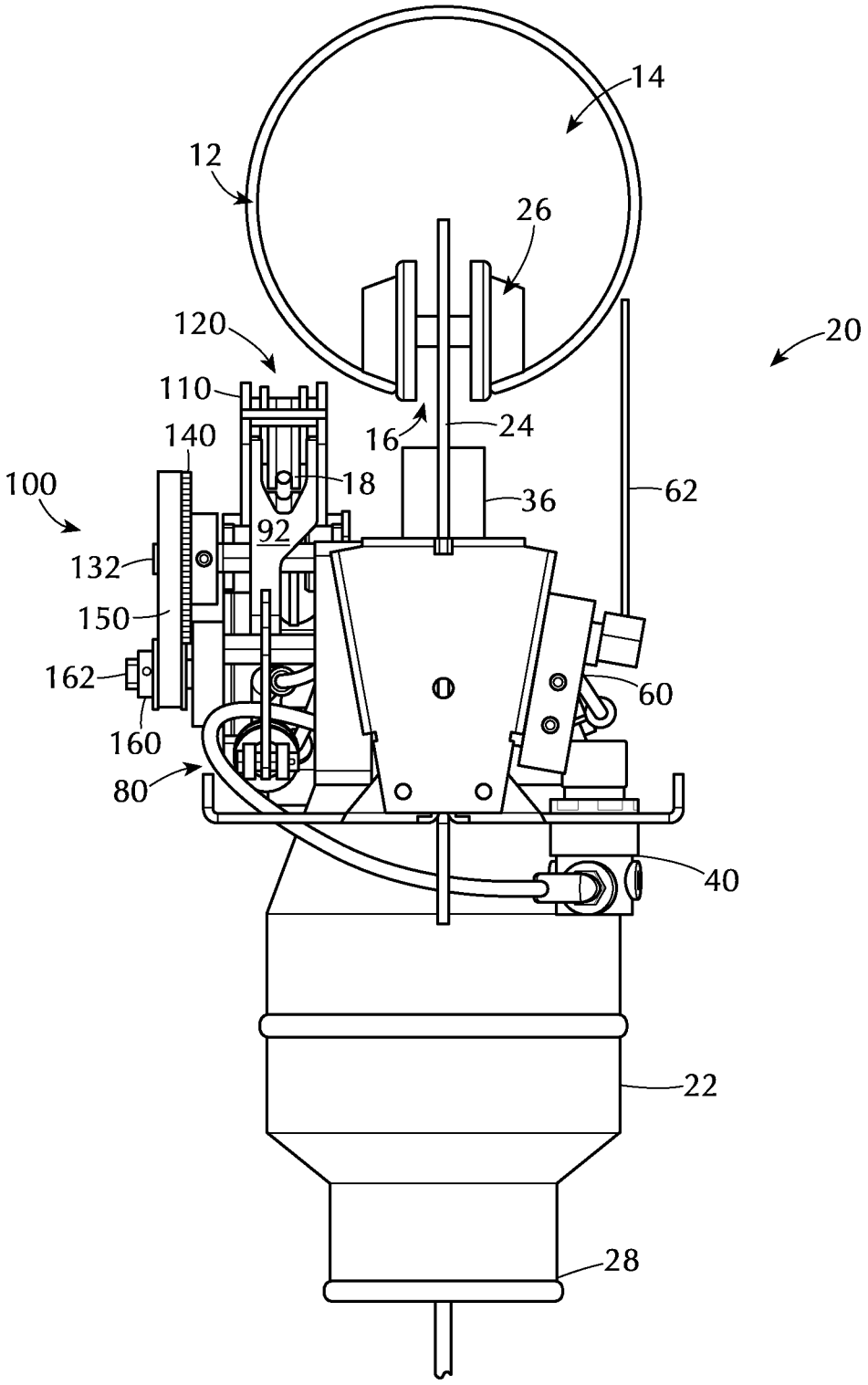
FIG. 3 is a rear perspective view of the automatic carriage return of FIG. 1.
Figure 4:
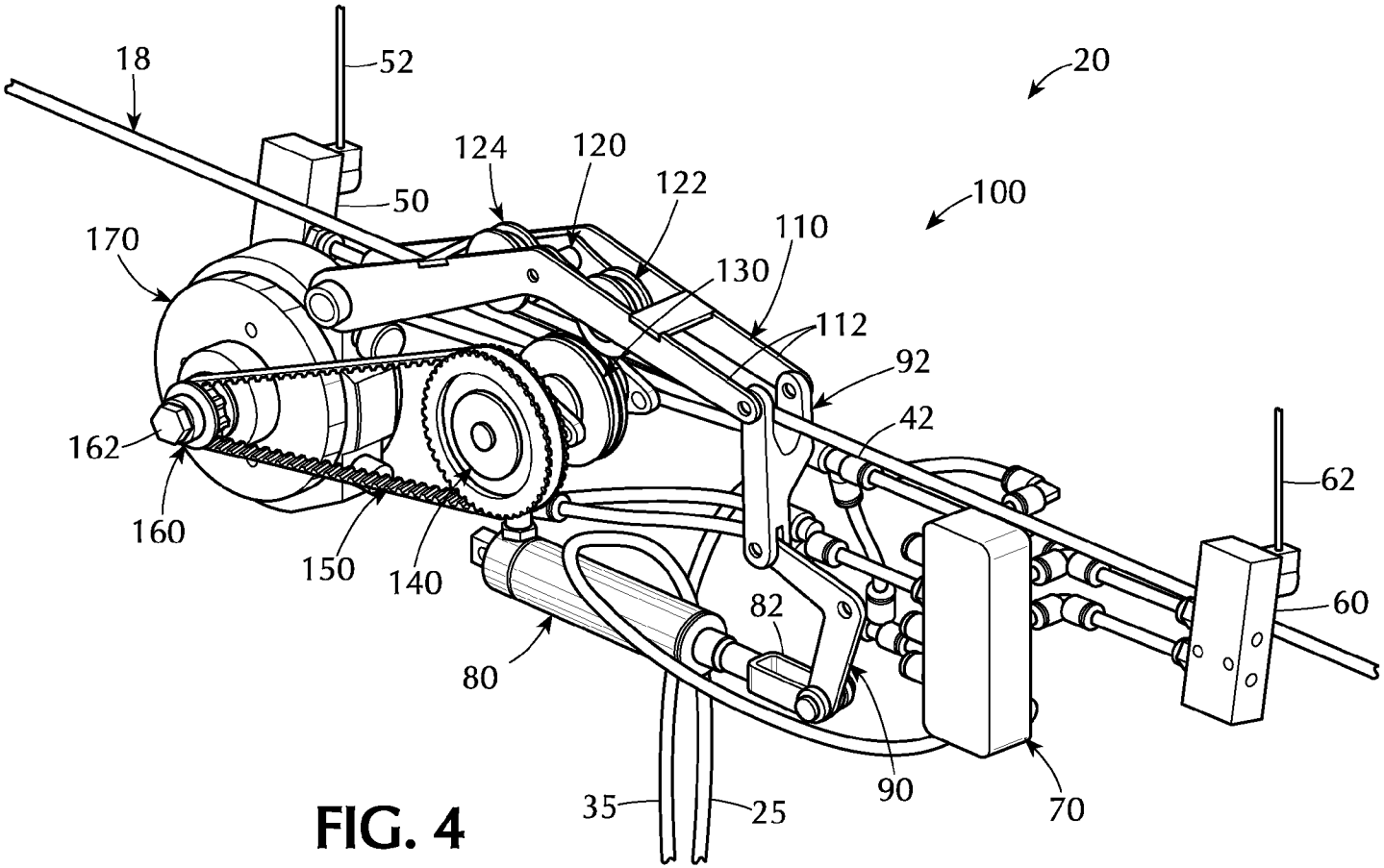
FIG. 4 is a perspective view of the drive side of the automatic carriage return of FIG. 1 with the carriage, track tube and main support bracket removed to show better detail.

FIGS. 1-6 show various views of an exhaust removal system 10 incorporating a pneumatically driven automatic carriage return 20 of the present invention. FIGS. 1 and 2 show perspective views of the control side and drive side, respectively, of the automatic carriage return 20. FIG. 3 shows a rear view of the automatic carriage return 20, and FIG. 4 is a perspective view of the drive side of the automatic carriage return with the carriage fairing 22, track tube 12, and main support bracket 23 removed to show better detail.

The exhaust removal system 10 comprises an exhaust removal hose 95 that is detachably coupled to the exhaust pipe (not shown) of a service vehicle (not shown). The opposite end of the exhaust hose 95 is coupled to a bottom end 28 of carriage fairing 22 via collar or clamp 53. The carriage fairing 22 is configured to direct exhaust upward and out slotted upper end 36 toward slot 16 in track tube 12. The track tube comprises a central channel 14 to receive the exhaust.

Referring to FIG. 3, the carriage 22 is configured to translate freely in a linear fashion across the bay via two sets of track wheels 26 that are disposed within in the central channel 14 of track tube 12. The track wheels 26 are rotatably attached to brackets 24 that couple the wheels 26 to the main support bracket 23. Thus, while the exhaust extraction hose 95 is coupled to the vehicle, it is the vehicles motion that drives motion of the carriage 22 along the track tube 12.

The return system 20 of the present invention is configured to only engage upon release of the exhaust extraction hose 95 from the exhaust of the vehicle, thus allowing the carriage assembly 30 to move freely within track tube 12. Furthermore, the return system 20 comprises an engagement assembly 100 and drive means that are powered entirely via a pneumatic air system that used for disengagement/release of the exhaust hose 95 from the truck upon exiting the bay.

Figure 6:
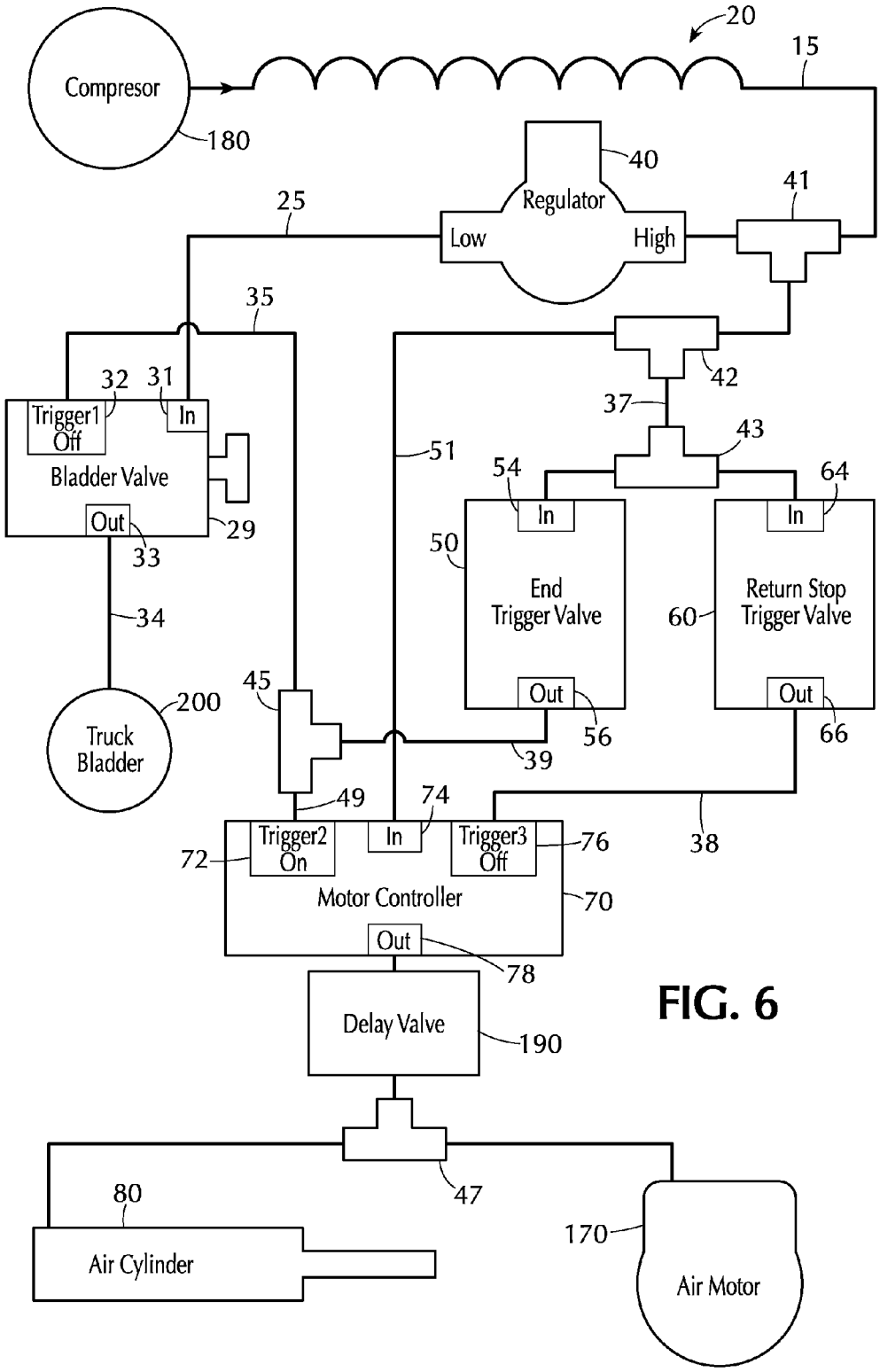
FIG. 6 illustrates a system air flow chart of the automatic carriage return of the present invention.

As detailed in FIGS. 1 and 6, the exhaust removal system 10 uses a retention bladder 200 to couple the exhaust hose 95 to the truck exhaust. The system takes high pressure air from the input tube 15 and directs the pressurized air to pressure regulator 40 to send low pressure to the bladder 200. A portion of the high pressurized air is directed to end trigger valve 50. Upon the vehicle reaching the exit side of the bay, end trigger valve 50 is activated from pivotable arm 52 rotating after hitting a stop (not shown), indicating the location of the carriage 30 at the end of the bay. Once activated, the trigger valve 50 is then sends a pressure signal via a release signal tube 45 to the bladder valve 29 (FIG. 6). The carriage return system 20 is further configured such that the end trigger valve 50 also sends a signal to activate the automatic return 20.

Figure 5A:
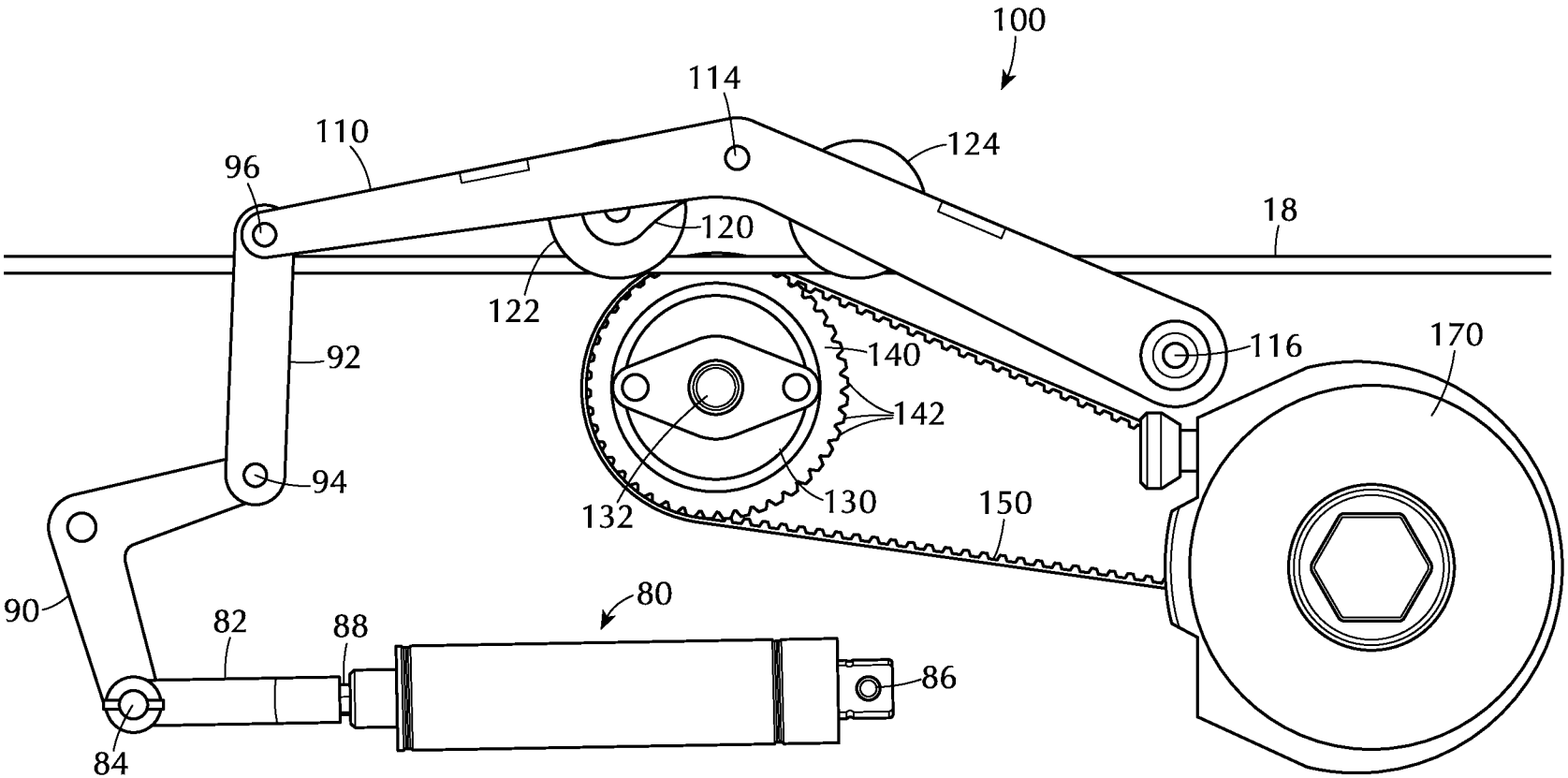
FIG. 5A is a side view of the of the automatic carriage return of FIG. 1 with the engagement mechanism disengaged.
Figure 5B:
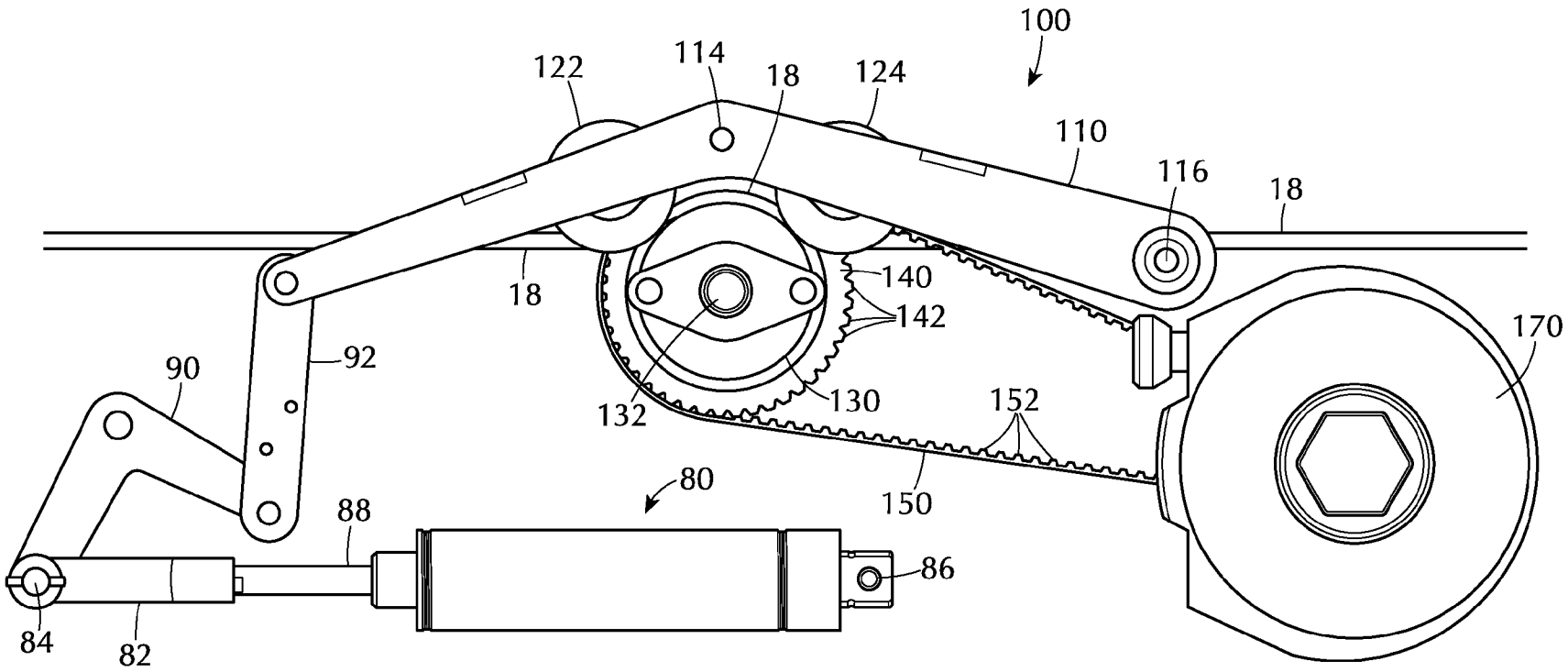
FIG. 5B is a side view of the of the automatic carriage return of FIG. 1 with the engagement mechanism engaged.

Referring now to FIGS. 4, 5A and 5B, the signal from end trigger valve 50 is sent to motor controller valve 70, which is configured to send high pressure air the pneumatic cylinder 80 and the pneumatic drive motor 170 to operate engagement and return drive means. FIGS. 4 and 5A illustrate the engagement mechanism 100 in a disengaged configuration. In this mode, the carriage assembly 30 is free to translate along the length track tube 12 without any, or substantially any, restriction from the return drive means. The return drive mechanism of the carriage assembly 30 is affected from contact between the drive wheel 130 and drive cable 18, wherein the position of the bogey 120 dictates whether or not the drive wheel 130 is in contact with the drive cable 18. As seen in FIGS. 1, 2 and 3, drive cable 18 spans across the bay along an axis substantially parallel to the axis of the track tube 12, at a location below and to one side of the track tube 12. During the disengaged mode illustrated in FIGS. 4 and 5A, the drive cable has minimal to no contact with the bogey wheels 130, 140 of bogey 120.

Referring now to FIG. 5B, the signal from end trigger valve 50 (triggered from the carriage assembly 30 reaching the end trigger valve 50) is sent to the motor controller valve 70, which sends high pressure air the pneumatic cylinder 80 and the pneumatic drive motor 170 to operate engagement and return drive means. The high pressure air drives the pneumatic cylinder 80 extend piston 88. The pneumatic cylinder 80 has a fixed end 86 that is restrained from translation, thus causing the piston 88 to push rod clevis 82 outward from the cylinder body. Motion of the rod clevis 82 applies a corresponding rotation to the crank arm 90 which is pivotably connected rod clevis pivot 84. The downward motion of crank arm 90 correspondingly pulls down on the Y Bar 92, which is coupled to the crank arm 90 at pivot 94. The Y Bar 92 is pivotably attached to free end of lever or bogey arms 110 at hinge 96, such that downward motion of the Y Bar 92 pivots the bogey arm 110 lowering the bogey 120 and bogey wheels 122,124 until they contact (or push down if already in contact) the drive cable 18. The opposing end of the bogey 120 is pivotably fixed at hinge 116 such that continued downward motion of the bogey arm 110 causes the drive cable 18 to be pinched between the bogey wheels 122, 124 and the drive wheel 130 (see FIG. 5B, showing the drive cable 18 being bent around drive wheel 130). This pinching action creates the friction necessary to drive the carriage assembly 30 forward along the drive cable 18 when the drive wheel 130 is rotated.

It is appreciated that prior to this engagement (which is triggered by release of the extraction hose from the vehicle), the return system 20 of the present invention in no way impedes the natural motion of the carriage assembly 30 as it follows the vehicle out the bay.

Rotation of the drive wheel 130 is accomplished by high pressure air traveling through the pneumatic drive motor 170, causing the output shaft 162 to rotate. The rotating shaft 162 is connected to the small toothed pulley 160. The rotation of the small toothed pulley 160 is transmitted via the toothed belt 18 to the large toothed pulley 140. The large toothed pulley 140 is directly coupled through a cross shaft to the drive wheel 130. Corresponding rotation of the large toothed pulley 140 directly rotates the drive wheel 130. Thus, the carriage assembly 30 is powered by the drive wheel 130 and drive cable 18 when in the engaged configuration of FIG. 5B, and travels down the track tube 12 towards the entrance side of the bay.

Upon reaching the entrance side of the bay, the pivoting arm 62 of trigger valve 60 rotates as it engages a stop (not shown) at or near the entrance. The motion of arm 62 activates stop trigger valve 60, sending a signal to the motor controller valve 70. The motor controller valve 70 then turns off the pressure supply to the pneumatic cylinder 80 and the pneumatic drive motor 170. This loss in pressure stops the rotation of the pneumatic drive motor 170 and causes the pneumatic cylinder 80 to retract pivot 88. The retraction of the cylinder pivot 88 correspondingly drives the engagement assembly linkage back to the disengaged configuration of FIG. 5A, releasing the pinch of bogey 120 on the drive cable 18. The carriage 30 now remains at the entrance side of the bay until it is pulled by a reconnected vehicle to the exit side of the bay where the return sequence starts again.

FIG. 6 illustrates flow chart of the air control of the carriage return 20 system of the present invention, wherein air from compressor 180 is feed to modulator 40, trigger valves 50, 60, motor controller 70, bladder valve 29, retention bladder 200, cylinder and motor 170.

It is appreciated that trigger valves 50, 60 are essentially sensors that detect the position of the carriage assembly 30, and send a pneumatic signal to valves 29, and 70 to operate or control various mechanical components of the system. While this configuration is advantageous in that it provides a sensing means that does not require any electrical power (and associated cables and/or batteries), it is understood that other sensors (e.g. pressure, optical, hall-effect sensors, RFID, or the like) available in the art may be used interchangeably with the return system 20 of the present invention.

As detailed in FIG. 6, high pressure air enters the system through the input tube 15 and travels to T-fitting 41, which splits the airflow between the pressure regulator 40 and a second T-fitting 42. Low pressure then travels from the pressure regulator 40 down the bladder valve tube 25 (see also FIG. 1) to input 31 of the bladder valve 29, where it inflates the retention bladder 200 (FIG. 6) to hold the extraction hose 95 to the vehicle's exhaust pipe (not shown).

Second T-fitting 42 splits airflow between line 37 and a third T-fitting 43 that supplies air to the inputs 54, 64 of respective end trigger valve 50 and return stop trigger valve 60, and line 51, which directs airflow to input 74 of motor controller 70.

Upon the vehicle reaching the exit side of the bay, end trigger valve 50 is activated, sending a pneumatic pressure signal through output 56 and line 39 to fourth T-fitting 45. Fourth T-fitting 45 splits the airflow between trigger 2 "on" input 72 of motor controller 70 and the release signal line 35 (see FIG. 1) coupled to trigger 1 "off" input 32 of the bladder valve 29. This trigger 1 "off" signal cuts air off of the output 33 and line 34 leading to retention bladder 200, causing the retention bladder 200 to deflate, thereby releasing the extraction hose 95 from the vehicle's exhaust pipe.

Simultaneous with sending the trigger 1 "off" signal, the air from output 56 of the end trigger valve 50 is also sent via the fourth T-fitting 45 out line 49 to the trigger 2 "on" input 72 of motor controller 70 to activate the automatic return 20. The signal from the trigger 2 "on" input 72 (indicating that the vehicle has reached the exit side of the bay and pending release of the bladder 200 from the vehicle exhaust) activates the motor controller valve 70 to send high pressure air through output 78 to delay valve 190. The delay valve 190 suspends the transmission of the air to T-fitting 47 for a specified period of time (e.g. 5 seconds). The delay period may be varied, but only needs to be enough time sufficient to ensure that the bladder 200 has been released from the vehicle exhaust before engagement of the return system 200. After the specified delay, the air is split at T-fitting 47 between the air cylinder 80 and the pneumatic drive motor 170 to activate engagement assembly 100 and radial motion of drive motor 170. The engagement assembly 100 then engages cable 18 and drives the carriage assembly 30 along track 12 toward the entrance of the bay.

Upon reaching the entrance side of the bay, the arm 62 of return stop trigger valve 60 is activated, which releases air through output 66 and line 38 to the trigger 3 "off" input 76 of the motor controller valve 70. The motor controller valve 70 then cuts off the pressure supply from output 78 to the pneumatic cylinder 80 and the pneumatic drive motor 170. This loss in pressure stops the rotation of the pneumatic drive motor 170 and causes the pneumatic cylinder 80 to retract pivot 88. The retraction of the cylinder pivot 88 correspondingly drives the engagement assembly linkage back to the disengaged configuration of FIG. 5A, releasing the pinch of bogey 120 on the drive cable 18. The carriage return assembly 30 is now free to translate along track tube 12 so that it may be free to move once the hose 95 is attached to the vehicle exhaust.

The above illustrated embodiment of automatic carriage return 20 is illustrated in FIGS. 1-6 to be installed as a retro-fit to an existing pneumatically-operated exhaust removal system that may already be in play in the emergency vehicle bay. In such case, the engagement assembly 100, motor controller 70 delay valve 190, air cylinder 80, air motor 170 return stop trigger valve 60, and accompanying fittings and lines are installed to attach to, or work in concert with, already existing regulator 40, bladder valve 29, bladder 200, end trigger valve 50, track tube 12 carriage fairing 22, main bracket, etc. Certain parts may be modified to allow for such retrofit. For example, the main bracket 32 may be modified to provide opening (clearance) 27 for small-toothed pulley 160.

However, it is appreciated that the present invention may comprise an exhaust removal system 10 comprising a carriage return system 20 as an integrated component.

Furthermore, the automatic carriage return 20 illustrated in FIGS. 1-6 is configured to operate pneumatically via pressurized air. However, it is appreciated that the principles of the present invention may be applied to systems using other driving or sensing means, e.g. electronic server motor, electromagnetic actuation, etc., or may include a mixture of components that are pneumatically operated and components using other drive/sensing means. In addition, it is appreciated that certain components may be interchangeably used with other components known in the art. For example, while the bogey/drive cable is a preferred engagement means for affecting return drive of the carriage assembly 30, it is possible that other possible releasable engagement means (e.g. rack and pinion, worm drive, etc.) may be used as well.

Figure 7:
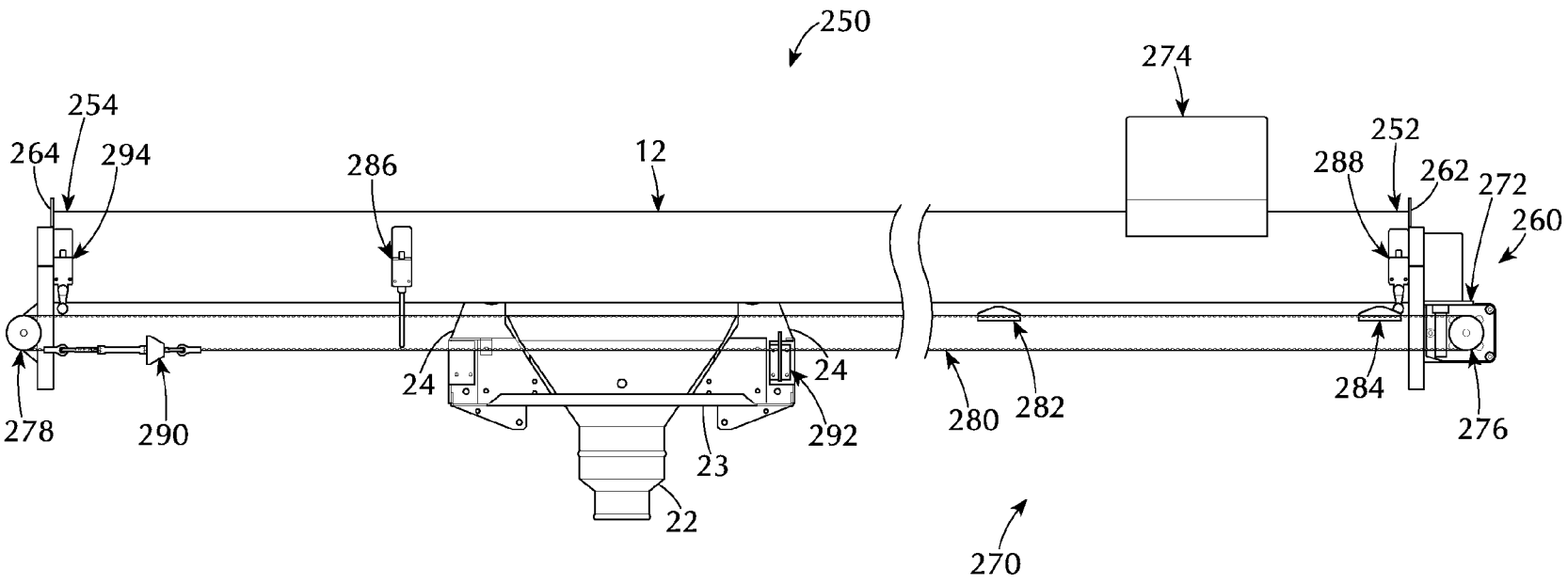
FIG. 7 illustrates a side view of an alternative automatic carriage return embodiment incorporating an electronic drive and drive belt in accordance with the present invention.
Figure 8:
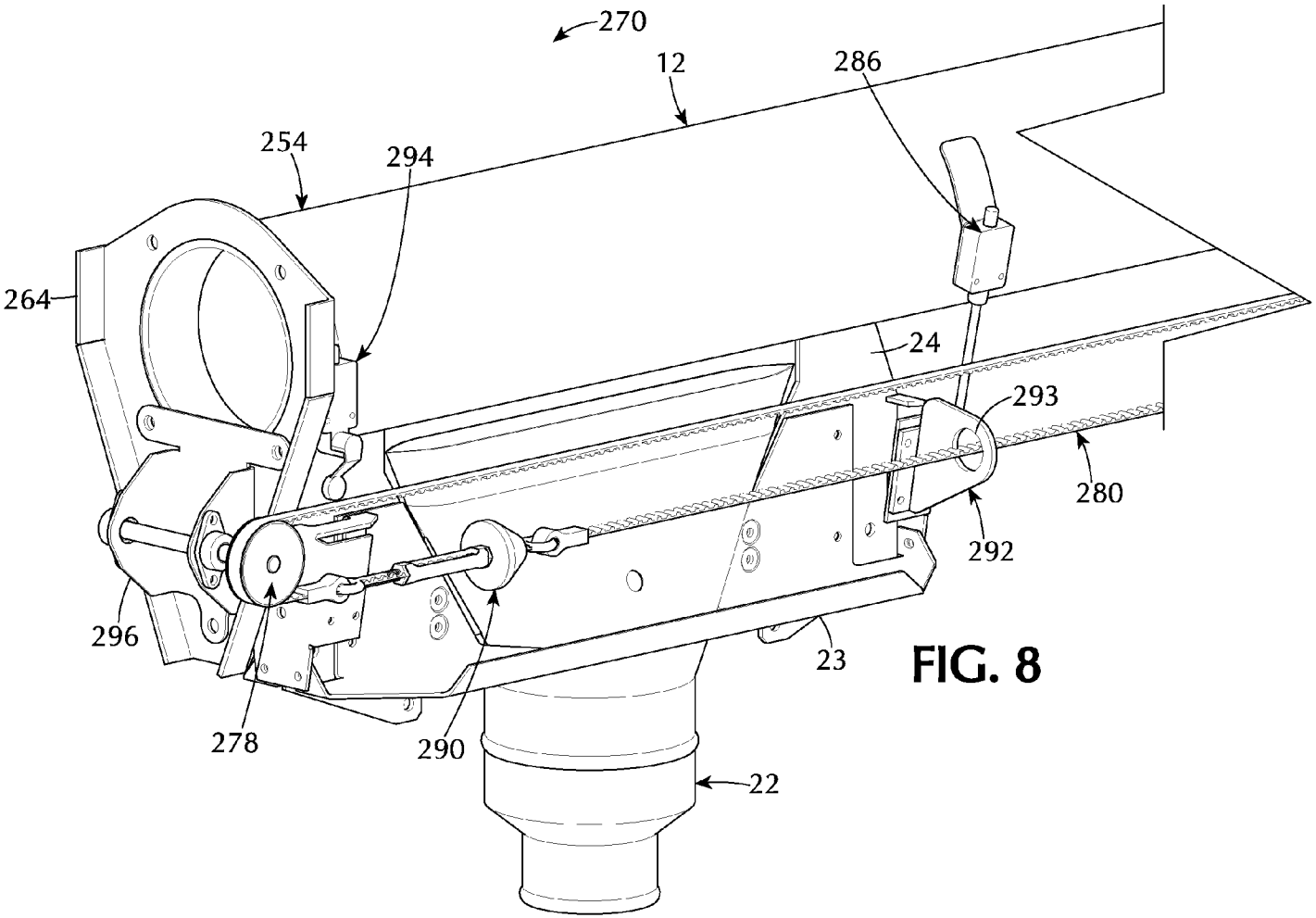
FIG. 8 illustrates a close-up perspective view of the exit side of the carriage return of FIG. 7.
Figure 9:
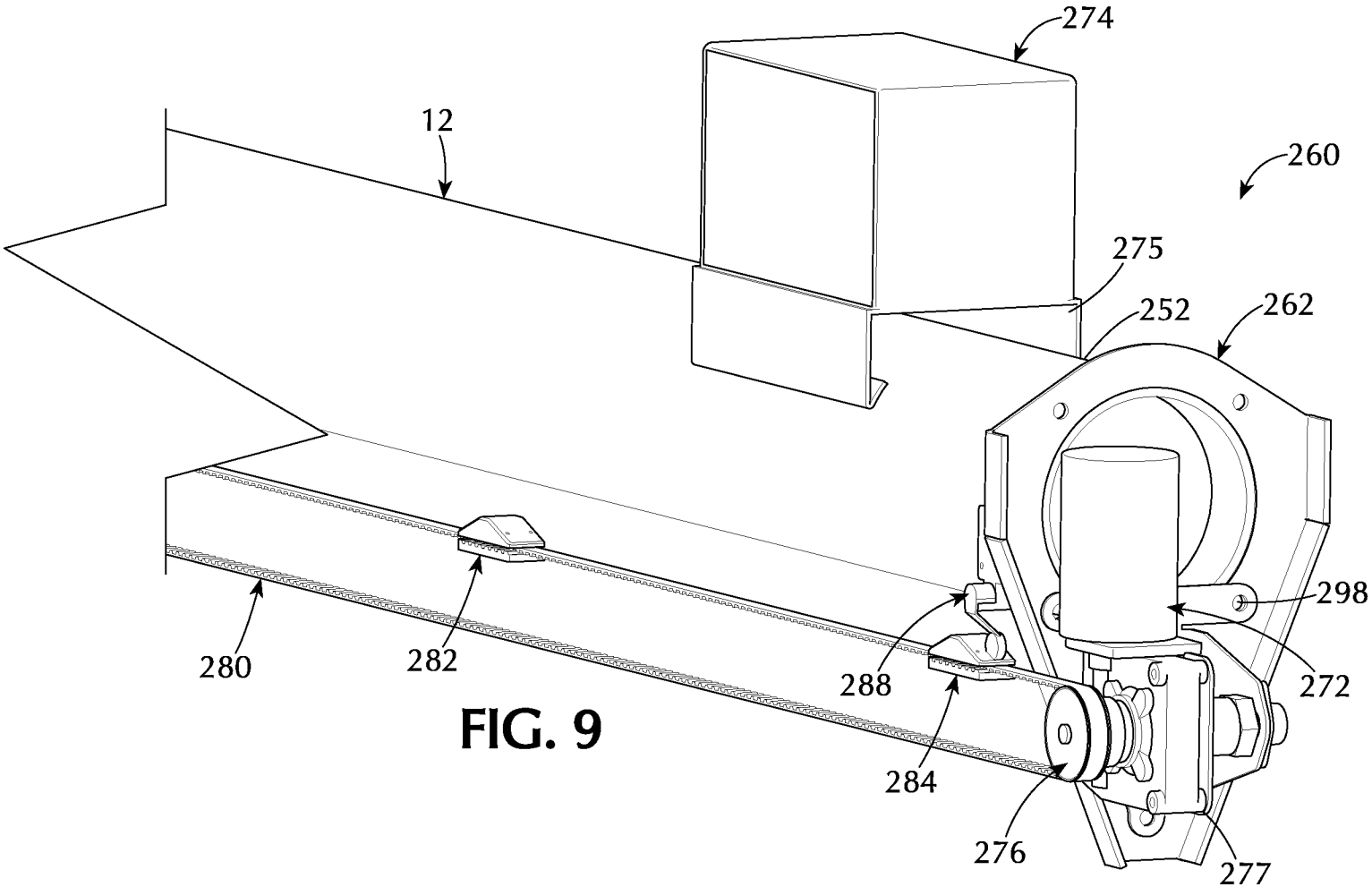
FIG. 9 illustrates a close-up perspective view of the entrance side of the carriage return of FIG. 7.

FIGS. 7 through 9 show an exhaust removal system 250 with an alternative automatic carriage return 270 incorporating an electronic drive 260. FIG. 7 illustrates a side view of exhaust removal system 250. FIGS. 8 and 9 show close-up perspective views of the exit side and entrance side, respectively, of the exhaust removal system 250 and carriage return 270. The automatic carriage return 270 is configured to operate independently, without pneumatic power as the motive force. The automatic carriage return 270 is particularly beneficial for systems incorporating electromagnetic disengagement/release of the exhaust hose, which do not use a pneumatic air system for disengagement/release of the exhaust hose 95 from the truck upon exiting the bay (see FIG. 1).

Referring to FIG. 7, the vehicle is attached to the exhaust extraction hose 95 (shown in FIG. 1), which is then connected to the carriage fairing 22. The carriage fairing 22 is attached to brackets 24 that ride in a rolling track inside the rail 12 (see FIG. 3). As with previous embodiments, the carriage fairing 22 is configured to direct exhaust upward and out track tube 12. With the automatic carriage return 270, carriage 22 is translates freely in a linear fashion across the bay via the track tube 12, such that when the exhaust extraction hose 95 is coupled to the vehicle, it is the vehicles motion that drives motion of the carriage 22 along the track tube 12. During this direction of travel (from the entrance side 252 of the track 12 to the exit side 254 of the track 12) the return system 270 is not engaged, and does not impede the natural motion of the carriage 22 as it follows the vehicle out the bay (a very small impedance may be generated from the use of mechanical sensors, but such impedance is negligible compared to friction, rolling resistance, etc. already present in the 250). The automatic carriage return 270 is one configured to engage and drive motion only in the opposite direction (from the exit side 254 of the track 12 to the entrance side 252 of the track 12) when the hose 95 is disengaged from the vehicle.

Referring to FIG. 8, as the vehicle exits the drive through bay, the extraction hose 95 and carriage 22 travel along track 12 until reaching the exit end 254 of the track 12, upon which the hose 95 automatically detaches from the vehicle. The automatic carriage retrieval system 270 is activated when the carriage 22 triggers carrier trigger switch 286 (from contact of the retrieval catch 292 with the trigger switch 286) prior to reaching the exit end 254 of the rail 12. Carrier trigger switch 286 is configured to sense a first trigger location corresponding to the carriage 22 being at or near the exit end 254 of the rail 12. This triggering starts a timer in the controller 274 that waits a specified interval (e.g. fifteen seconds) and then activates the drive 272 on the entrance side 252 of the rail 12.

As shown in FIG. 9, the controller 274 is generally attached to the rail 12 via a bracket 275. However, other locations and/or attachment means available in the art are also contemplated. The controller 274 may comprise a power source, processor, memory, programming executable on the processor, and other logic (all not shown) for operating the timing and activation of drive motor 272. The controller 274 may be coupled to drive motor 272 and switches 286, 288, and 294 via leads (not shown) or wireless transceiving means (not shown).

The drive 272 may comprise a servo motor, or the like, to generate rotational motion to act on drive pulley 276, which in turn drives linear motion of linear drive means 280. It is also appreciated the drive 272 may comprise any means (e.g. linear actuator, etc.) for driving motion known in the art. Although drive means 280 may comprise many forms, drive means 280 preferably comprises a drive line or drive belt 280 that is fixed in a loop around the drive pulley 276 and the idler pulley 278. The electronic drive assembly 260 (comprising motor 272, transmission 277, pulley 276, etc.) is coupled to the exhaust system 250 via a bracket 298 that interfaces with entrance side bracket 262 that fixes the entrance end 252 of rail 12. Correspondingly, the idler pulley 278 is coupled to the exhaust removal system 250 via a bracket 296 that interfaces with exit side bracket 264 that fixes the exit end 254 of rail 12 (see FIG. 8).

Referring now to FIG. 8, attached to lower loop of this belt 280 is the retrieval cone 290, which is configured to contact and be received within aperture 293 of the retrieval catch 292 that is attached to the main bracket 23 of the carriage 22. Upon contact, the retrieval cone 290 will drive the carriage 22 to the entrance side 252 of the rail 12.

Attached to the upper loop of the belt 280 are exit side trip 282 and entrance side trip 284. As the carriage 22 is taken to the entrance side 252 of the rail, exit side trip 282 is driven towards the exit side 252 of the rail 12. As exit side trip 282 nears the exit end 252 of the rail 12, it trips switch exit side switch 294, signaling the controller 274 to stop the drive motor 272. Exit side switch 294 is configured to sense a second trigger location corresponding to the carriage 22 being at or near the entrance end 252 of the rail 12. The controller 274 then tells the drive motor 272 to reverse direction and send the retrieval cone 290 back to the exit side 254 of the rail 12 (the carriage 22 stays in place at the entrance end 252 because the cone 290 and retrieval catch 292 are only configured to engage in one direction).

As the retrieval cone 290 nears the exit side 254, entrance side trip 284 is nearing the entrance side 252 of the rail 12, which then makes contact with entrance side switch 288. This positioning is illustrated in FIG. 7. However, it should be noted that the carriage 22 is shown in FIG. 7 away from entrance end 252 and exit end 254. This is for illustrative purposes only, as the carriage would generally be residing at the entrance side 254 during this time. The contact of entrance side trip 284 with entrance side switch 288 triggers the controller 274 to stop the drive motor 272. The carriage 22 is now sitting at the entrance side 252 of the rail 252 waiting for the vehicle to return. The retrieval cone 290 is now at the exit side 254 of the rail 12, so as to not interfere with the free movement of the carriage 22 when the vehicle re-enters the building.

The switches 286, 288, and 294 are shown in FIGS. 7-9 as electro-mechanical switches. However, it is understood that one of more of switches 286, 288, and 294 may comprise any type of sensor (e.g. pressure, optical, hall-effect sensors, RFID, or the like) available in the art, and may be used interchangeably with the return system 250 of the present invention.

The above illustrated embodiment of automatic carriage return 270 is illustrated in FIGS. 7-9 to be installed as a retro-fit to an existing electro-magnetic operated exhaust removal system 250 that may already be installed in the emergency vehicle bay. In such case, the electronic drive assembly 260 and belt 280 work in concert with already existing components, e.g. rail 12, carriage 22, etc. Certain parts may be modified to allow for such retrofit.

However, it is appreciated that the present invention may comprise an exhaust removal system 250 comprising a carriage return system 270 as an integrated component.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An automatic carriage return for an exhaust removal system having a carriage that is configured to translate in first and second directions along a track tube, the carriage being coupled to an exhaust extraction hose, the exhaust extraction hose being coupled to a vehicle exhaust for directing exhaust from the vehicle out the track tube, the automatic carriage return comprising:

a reciprocating drive line spanning along a path adjacent to and substantially parallel with the track tube;

an passive engagement catch coupled to the carriage, the engagement catch being engaged to the drive line while the carriage is travelling in the first direction;

wherein the drive line is not engaged with the engagement catch or carriage when the carriage is traveling in the second direction such that the carriage moves independently of the drive line when the carriage is traveling in the second direction; and a drive coupled to the drive line, the drive configured to drive motion of the drive line and carriage in the first direction.

2. An automatic carriage return as recited in claim 1, wherein the carriage is configured to travel in the second direction from a first location along the track to a second location along the track while the exhaust extraction hose is coupled to a vehicle exhaust.

3. An automatic carriage return as recited in claim 2, wherein the drive and drive line are configured return the carriage from the second location to the first location.

4. An automatic carriage return as recited in claim 3, further comprising:

a first sensor;

the first sensor in electrical communication with the drive;

the first sensor configured to sense a first trigger location of the carriage with respect to the track tube;

the first trigger location corresponding to the carriage being at or near the second location of the track tube; and wherein the drive is configured to drive motion of the drive line and carriage in the first direction upon the first sensor sensing the carriage at the first trigger location.

5. An automatic carriage return as recited in claim 4, further comprising:

a second sensor in electrical communication with the drive;

the second sensor configured to sense a second trigger location of the carriage with respect to the track tube;

the second trigger location corresponding to the carriage being at or near the first location on the track tube; and wherein the drive is configured to drive motion of the drive line in the second direction upon the second sensor sensing the carriage at the second trigger location.

6. An automatic carriage return as recited in claim 5, further comprising:

a third sensor in electrical communication with the drive;

the third sensor configured to sense a location of the drive line respect to the track tube; and wherein the drive is configured stop motion of the drive line in the second direction upon the third sensor sensing the location of the drive line.

7. An automatic carriage return as recited in claim 6, further comprising:

a controller coupled to the first sensor, second sensor, third sensor, and the drive;

wherein the controller is configured to initiate engagement of the drive upon receiving data from one or more of the first sensor, second sensor, third sensor.

8. An automatic carriage return as recited in claim 1, wherein the drive line comprises a drive belt supported around one or more pulleys.

9. An automatic carriage return as recited in claim 8, wherein the drive comprises a drive motor that drives the one or more pulleys.

10. An exhaust removal system with automatic carriage return, comprising:

a carriage;

an exhaust extraction hose;

the carriage being coupled to a first end of the exhaust extraction hose;

wherein the carriage is configured to translate in first and second directions along a track tube;

wherein a second end of the exhaust extraction hose is configured to be releasably coupled to a vehicle exhaust for directing exhaust from the vehicle out the track tube;

a reciprocating drive line spanning along a path adjacent to and substantially parallel with the track tube;

a passive engagement catch coupled to the carriage, the engagement catch being engaged to the drive line while the carriage is travelling in the first direction;

wherein the drive line is not engaged with the engagement catch or carriage when the carriage is traveling in the second direction such that the carriage moves independently of the drive line when the carriage is traveling in the second direction; and a drive coupled to the drive line, the drive configured to drive motion of the drive line and carriage in the first direction.

11. An exhaust removal system as recited in claim 10, wherein the carriage is configured to travel in the second direction from a first location along the track to a second location along the track while the exhaust extraction hose is coupled to a vehicle exhaust.

12. An exhaust removal system as recited in claim 11, wherein the drive and drive line are configured return the carriage from the second location to the first location.

13. An exhaust removal system as recited in claim 12, further comprising:

a first sensor;

the first sensor in electrical communication with the drive;

the first sensor configured to sense a first trigger location of the carriage with respect to the track tube;

the first trigger location corresponding to the carriage being at or near the second location of the track tube; and wherein the drive is configured to drive motion of the drive line and carriage in the first direction upon the first sensor sensing the carriage at the first trigger location.

14. An exhaust removal system as recited in claim 13, further comprising:

a second sensor in electrical communication with the drive;

the second sensor configured to sense a second trigger location of the carriage with respect to the track tube;

the second trigger location corresponding to the carriage being at or near the first location on the track tube; and wherein the drive is configured to drive motion of the drive line in the second direction upon the second sensor sensing the carriage at the second trigger location.

15. An exhaust removal system as recited in claim 14, further comprising:

a third sensor in electrical communication with the drive;

the third sensor configured to sense a location of the drive line respect to the track tube; and wherein the drive is configured stop motion of the drive line in the second direction upon the third sensor sensing the location of the drive line.

16. An exhaust removal system as recited in claim 15, further comprising:

a controller coupled to the first sensor, second sensor, third sensor, and the drive;

wherein the controller is configured to initiate engagement of the drive upon receiving data from one or more of the first sensor, second sensor, third sensor.

17. A method for automatically returning a carriage for an exhaust removal system, comprising:

coupling a first end of the carriage to an exhaust extraction hose;

coupling a second end of the exhaust extraction hose to a vehicle exhaust for allowing the carriage to translate along a track tube as the vehicle moves in a first direction while directing exhaust from the vehicle out the track tube;

the track tube comprising an exit end and entrance end;

allowing the carriage to translate in the first direction disengaged from a reciprocating drive line such that the carriage moves independently of the drive line from the entrance end of the track tube, the drive line spanning along a path adjacent to and substantially parallel with the track tube;

upon the carriage reaching the exit end of the track tube, releasing a second end of the exhaust extraction hose from the vehicle exhaust, and engaging a drive line with the carriage; and driving motion of the carriage via the drive line in engagement with a passive engagement catch in a second direction to return the carriage to the entrance end of the track tube.

18. A method as recited in claim 17, further comprising:

sensing a first location of the carriage with respect to the track tube;

the first location corresponding to the carriage being at or near the exit end of the track tube; and driving motion of the drive line in response to sensing the first location of the carriage to engage and drive the carriage in the first direction to return the carriage to the entrance end of the track tube.

19. A method as recited in claim 18, further comprising:

sensing a second location of the carriage with respect to the track tube;

the second location corresponding to the carriage being at or near the entrance end of the track tube; and driving motion of the drive line in response to sensing the second location of the carriage to translate the drive line in the second direction.

20. A method as recited in claim 19, further comprising:

sensing a location of the drive line with respect to the track tube;

the location of the drive line corresponding to an engagement element of location of the drive line being at or near the exit end of the track tube; and stopping motion of the drive line in response to sensing the location of the drive line.

* * * * *